United States Patent [19]

Borland et al.

[11] 4,325,008

[45] Apr. 13, 1982

[54] CLAMP ASSISTED CYCLE CONTROL REGULATING SYSTEM

[75] Inventors: Walter G. Borland; Robert F. Brehse, both of Fort Wayne, Ind.

[73] Assignee: General Electric Company, Salem, Va.

[21] Appl. No.: 157,629

[22] Filed: Jun. 9, 1980

[51] Int. Cl.[3] ..... H05B 41/34

[52] U.S. Cl. ..... 315/241 R; 315/224; 315/225; 315/278; 320/1

[58] Field of Search ..... 315/200 A, 224, 241 R, 315/241 P, 225, DIG. 7, 278; 320/1; 355/3, 69; 323/268, 271, 288; 331/94.5 P

[56] References Cited

U.S. PATENT DOCUMENTS

| | | | |
|---|---|---|---|
| 3,476,977 | 11/1969 | Hallay | 315/183 |
| 3,749,976 | 7/1973 | Colyn | 315/241 R |
| 3,821,635 | 6/1974 | Kimmel et al. | 320/1 X |
| 3,890,562 | 6/1975 | West | 315/241 R X |

*Primary Examiner*—Eugene R. La Roche

*Attorney, Agent, or Firm*—James H. Beusse; Arnold E. Renner

[57] ABSTRACT

A precision regulated power supply for charging an energy storage capacitor wherein regulation is achieved using a triac to interrupt a connection between a primary winding of a transformer and a DC power source. The circuit is useful in a power supply for a photocopier flash lamp where precision regulation of light intensity is required. A control winding is wound on the transformer closely coupled to the power secondary winding. A triac is connected across the control winding such that the winding can be short circuited when it is desired to cease charging of the storage capacitor. Short-circuiting of the control winding collapses the voltage on the transformer secondary winding thereby inhibiting the flow of current in the secondary winding. Regulating circuitry senses the voltage on the capacitor and gates the control winding triac into conduction when that voltage reaches a desired magnitude.

5 Claims, 3 Drawing Figures

CLAMP ASSISTED CYCLE CONTROL REGULATING SYSTEM

BACKGROUND OF THE INVENTION

The present invention relates to an improvement in regulated power supplies and, more particularly, to an improvement in power supplies for developing a highly accurate voltage magnitude for application to a cyclical load such as a flash lamp.

Various types of power supplies are used in cyclical load applications. Generally, all these power supplies utilized some means of charging an energy storage capacitor to a predetermined voltage magnitude. The energy in the capacitor is then discharged through the load when desired. In flash lamp applications, the energy discharge is converted to light and heat by discharge through the "arc" lamp.

A typical power supply for a flash lamp uses "on-off" primary control and a high leakage reactance power transformer. In such a system, a regulating circuit monitors the voltage developed on the output capacitor and interrupts the primary winding of the transformer when the capacitor voltage reaches the predetermined magnitude. Interruption of power to the primary winding is effected by removing a gate signal from a triac which is connected between the primary winding and an AC source. Capacitor charging is thereby terminated and the capacitor remains charged until called upon to discharge through the flash lamp. This circuit performs well in applications not requiring precise regulation of the energy in the capacitor. Because of the method of control, energy is delivered to the capacitor in half-cycle increments of the applied AC voltage. Since the triac switch is not force commutated when its gate signal is removed, the charging process cannot be stopped until the primary winding current passes through zero. Under worst case conditions, energy could be delivered to the capacitor for nearly a full half-cycle of the applied AC voltage after the triac gate signal has been removed. This excess energy would then result in higher light intensity being developed by the flash lamp. When the flash lamp is part of a photocopier, the increased light intensity will result in overexposure of the photocopy. Adjustments to compensate for such overexposure are impractical since the time at which the gating signal is removed with respect to the phase angle of the AC source voltage is unpredictable.

SUMMARY OF THE INVENTION

It is an object of the present invention to provide a regulated power supply having more precise control of the output voltage.

In accordance with the present invention, a prior art regulated power supply for flash lamp application is improved by the addition of a control winding to the secondary side of a leakage reactance power transformer. A triac is connected across the control winding and is used to clamp the secondary of the transformer core whereby power output from the secondary side of the transformer is inhibited. The DC output voltage of the power supply developed across an output capacitor is sensed by a voltage regulator circuit. When the output voltage attains a predetermined magnitude, the voltage regulator terminates a gate signal which was applied to force conduction of a triac interconnecting a primary winding of the transformer and an AC source. The termination of the gate signal is utilized to generate an additional gate signal which is applied to force conduction of the triac connected across the control winding thereby immediately inhibiting further enhancement of the voltage on the output capacitor even though current continues to flow through the transformer primary winding until the AC source current passes through zero.

BRIEF DESCRIPTION OF THE DRAWING

For a better understanding of the present invention, reference may be had to the accompanying detailed description taken in conjunction with the following drawings in which.

DESCRIPTION OF THE PREFERRED EMBODIMENT

Figure 1:
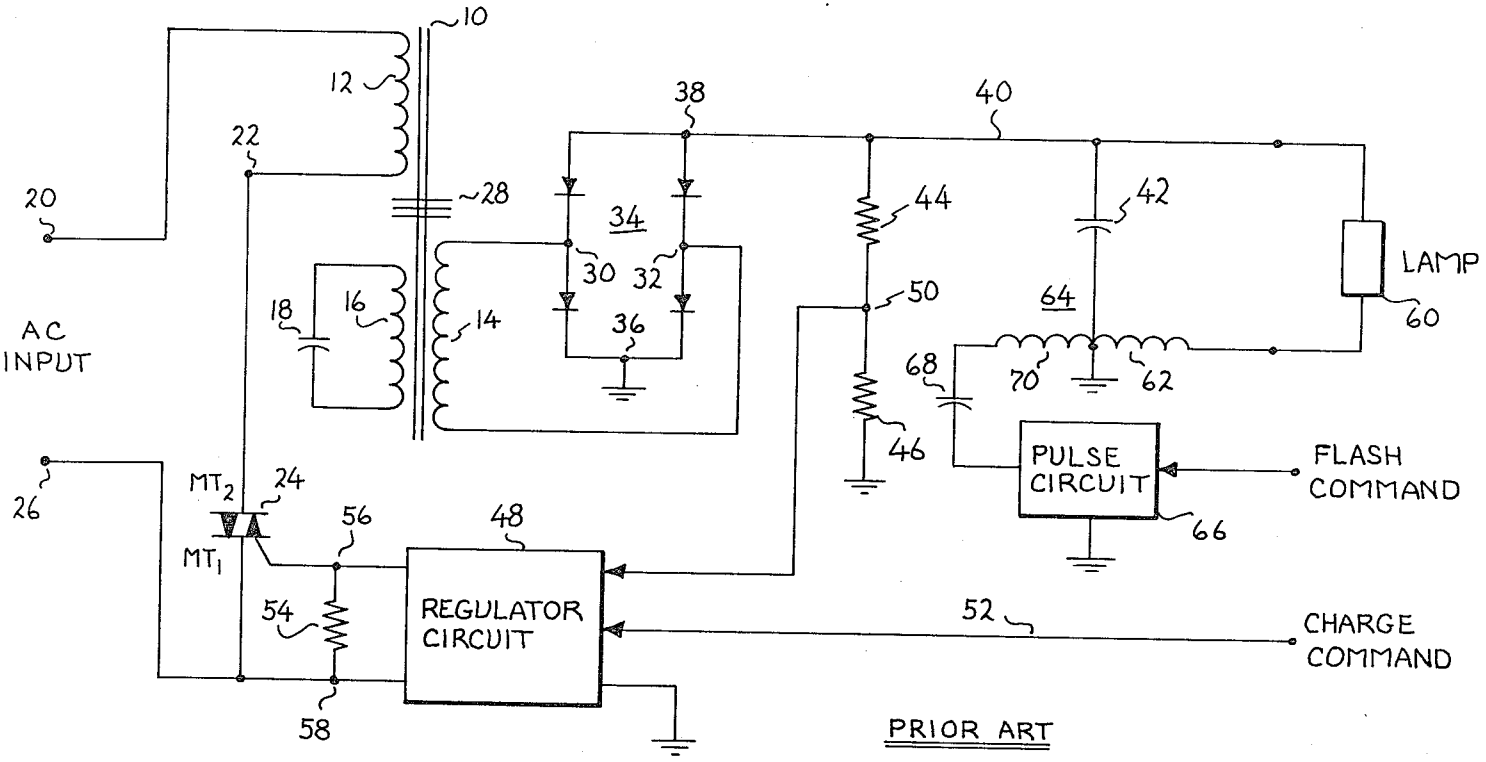
FIG. 1 is a typical prior art regulated power supply circuit for an arc-type flash lamp.

Referring now to FIG. 1, a typical prior art regulated power supply includes a high leakage reactance power transformer 10 having a primary winding 12, a power output secondary winding 14 and a power factor correction winding 16. A capacitor 18 connected across winding 16 provides input power factor improvement in order to minimize input current. The primary winding 12 has an input terminal 20 for connection to a source of alternating current (AC) power and an input terminal 22 which is connected to one terminal of a triac 24. A second terminal of the triac 24 is connected to an input terminal 26 adapted for connection to the AC power source whereby the triac 24 forms an interruptable connection between the primary winding 12 and the AC power source. The transformer 10 is of the current limiting type incorporating current shunts 28. A more detailed description of such a transformer is given in U.S. Pat. No. 3,319,204, issued May 9, 1967 and assigned to General Electric Company.

Output terminals of secondary winding 14 are connected to input terminals 30 and 32 of a diode bridge rectifier circuit 34. A first output terminal 36 of circuit 34 is connected to a reference plane such as a ground potential. A second input terminal 38 of circuit 34 is connected to a voltage bus 40. The DC voltage developed by the rectifier circuit 34 between the DC bus 40 and ground is applied across an output capacitor 42 connected between bus 40 and ground. The voltage developed on capacitor 42 is also impressed on a voltage divider circuit comprising resistor 44 and 46 serially connected between bus 40 and ground.

The magnitude of voltage developed on capacitor 42 is sensed by a voltage regulator circuit 48 which has one input terminal connected to a junction 50 intermediate resistors 44 and 46 and a second input terminal connected to ground. Voltage regulator circuit 48 may be any of the well-known types of regulator circuits adapted to compare a monitored voltage with a reference voltage and to provide a predetermined output signal indicative of whether the monitored voltage exceeds the reference voltage or vice versa. In this instance, the regulator circuit 48 provides an output gating signal to the gate terminal of triac 24 which will cause triac 24 to be gated into conduction when a reference voltage is greater than the scaled monitored voltage on capacitor 42. The regulator circuit 48 also incorporates an inhibit circuit such as, for example, a logical AND circuit, which inhibits production of a gating signal until receipt of a "Charge Command" signal on line 52. The "Charge Command" signal is provided by an external source (not shown) and indicates when it is desired to charge the capacitor 42.

The gating signal generated by regulator circuit 48 is developed across a resistor 54 connected between output terminals 56 and 58 of the circuit 48. The gate terminal of the triac 24 is connected to terminal 56 and its $MT_1$ terminal is connected to terminal 58. A detailed description of triac operation and gating circuits may be had by reference to the *SCR MANUAL,* 5th Edition, published in 1972 by General Electric Company, Semiconductor Products Department, Syracuse, New York.

The circuit of FIG. 1 is commonly used in the photocopier art and in this regard there is shown a flash lamp 60 which may be a xenon flash tube. The lamp 60 has one terminal connected to bus 40 and a second terminal connected to a first end of a secondary winding 62 of a pulse transformer 64 connected in an autotransformer configuration. A second end of winding 62 is connected to ground thus forming a series circuit comprising the lamp 60, the winding 62 and the capacitor 42. However, until conduction has been initiated in the lamp 60, no current will flow in this series circuit. Although illustrated as a series connected pulse start circuit, it will be apparent that the circuit could also be connected for parallel starting of the lamp 60, e.g., wherein the secondary winding is wrapped around the lamp rather than being connected in a lamp current path.

The lamp 60 is initially "started", i.e., the gases within the lamp are ionized so that conduction can occur, by application of a high voltage pulse some five to ten times the magnitude of the voltage on capacitor 42. The high voltage pulse is provided by a pulse circuit 66 which charges a capacitor 68 and thereafter discharges the capacitor 68 through a primary winding 70 of pulse transformer 64. The pulse circuit 66 is of a type well known in the art and includes power supply apparatus for developing a voltage to charge capacitor 68. Pulse circuit 66 responds to a "Flash Command" from a logic circuit (not shown) for discharging capacitor 68 through winding 70.

As will be apparent, the prior art circuit works well in those situations wherein the voltage on capacitor 42 need not be precisely regulated. Even though the regulator circuit 48 may be precise in removing the gating signal from triac 24, the triac 24 will not actually cease conduction until the current through it goes to zero. Accordingly, additional charging of capacitor 42 will occur subsequent to removal of the gating pulse. A more detailed description and discussion of operation of a typical prior art circuit similar to that of FIG. 1 may be had by reference to U.S. Pat. No. 3,890,562, issued June 17, 1975, and to U.S. Pat. No. 3,476,977, issued Nov. 4, 1969, both assigned to the assignee of the present invention.

In the operation of the circuit of FIG. 1, an AC voltage is available at terminals 20 and 26. However, no current can flow through primary winding 12 until triac 24 is gated into conduction. As soon as a Charge Command signal is supplied to regulator circuit 48, and because the reference voltage is greater in magnitude than the voltage on capacitor 42, a gating signal is supplied to triac 24 gating it into conduction thus allowing current to flow in winding 12 and charging current to flow from winding 14 to capacitor 42. Once the voltage on capacitor 42 reaches the predetermined magnitude set by the reference voltage, the gating signal is removed from triac 24. Charging, however, does not cease until current through triac 24 passes through zero. When a Flash Command is received by pulse circuit 66, the energy stored in capacitor 68 is discharged through primary winding 70 of pulse transformer 64. The voltage developed on secondary winding 62 forces ionization of gases in lamp 60 causing it to become conductive. Capacitor 42 then discharges through the lamp 60 to provide a controlled light intensity. As noted previously, however, the light intensity can only be precisely controlled if the voltage on capacitor 42 can be precisely controlled.

Figure 2:
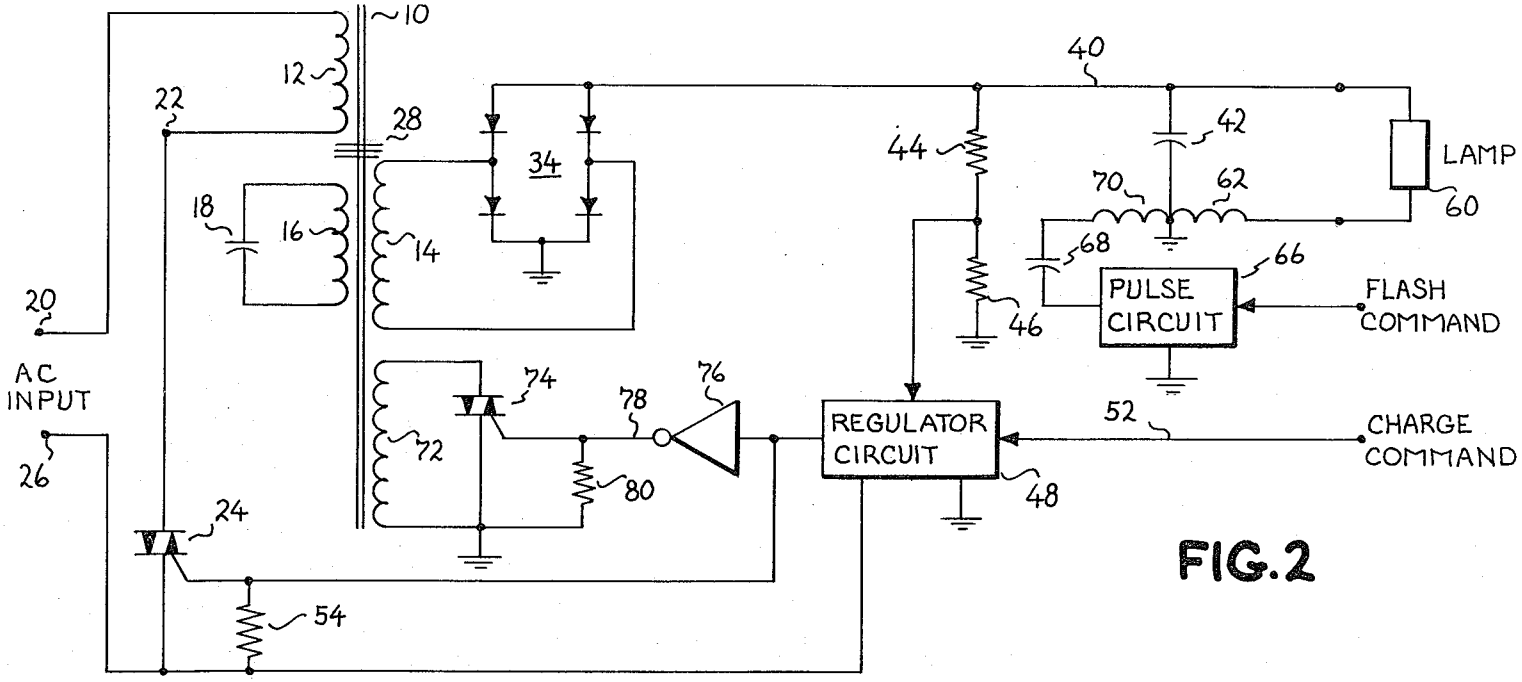
FIG. 2 illustrates a preferred form of the present invention in regulated power supply circuits; and, FIG. 3 illustrates a simplified equivalent circuit of the significant inventive features of FIG. 2.

Referring now to FIG. 2, there is shown an improved power supply circuit according to the present invention. The transformer 10 is modified by the addition of a control winding 72 to its secondary side. The control winding 72 is closely coupled to winding 14. A triac 74 is connected across the winding 72. The gating signal produced by regulator circuit 48 is inverted by an inverter circuit 76 and the inverted gate signal coupled via line 78 from an output terminal of inverter circuit 76 to a gate terminal of triac 74. A resistor 80 interconnects the gate and $MT_1$ terminals of triac 74.

The operation of the circuit of FIG. 2 is substantially the same as FIG. 1 except that simultaneous with the application of a gating signal to triac 24, an inverted signal is applied to the gate of triac 74. When triac 24 is gated into conduction, triac 74 receives a signal to hold it into a nonconductive state. When the gating signal is removed from triac 24, the inverter 76 provides a gating signal to immediately force conduction of triac 74, thereby short-circuiting the winding 72. Because the winding 72 is closely coupled to the winding 14, short-circuiting winding 72 collapses the voltage across winding 14 so that charging of capacitor 42 immediately ceases.

Figure 3:
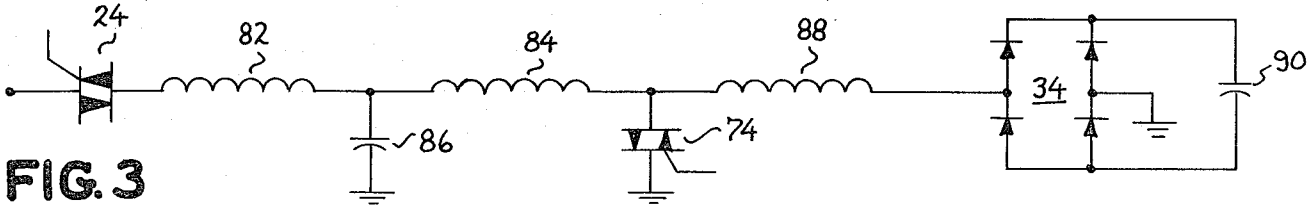

For a better understanding of the operation of the invention, reference may be had to the simplified equivalent circuit of the invention illustrated in FIG. 3. The circuit of FIG. 3 neglects the magnetizing reactance of the primary and secondary portions of the core of transformer 10. An inductance 82 representing the leakage reactance of the primary side of transformer 10 is coupled between the triac 24 and an inductance 84 representing the leakage reactance between the capacitor 18 and control winding 72. A capacitance 86 representing the reflected reactance of capacitor 18 is connected between ground and the junction mediate inductance 82 and inductance 84. An inductance 88 representing the leakage reactance between the secondary winding 14 and control winding 72 connects the inductance 84 to the rectifier circuit 34. The reflected value of the capacitor 42 is depicted as capacitance 90 connected across rectifier circuit 34.

When the triac 24 is turned on by applying a gate signal from regulator circuit 48, the charging cycle is initiated. The voltage on capacitor 42 is sensed and when it reaches the desired magnitude, the gate signal to triac 24 is removed and triac 74 is gated into conduction. The conduction of triac 74 causes the remaining half-cycle of energy delivered from the AC source and any energy stored in the leakage reactances 82 and 84 to be shunted through the control winding 72, thus terminating the charging of capacitor 42 at precisely the energy level desired. The reactances of FIG. 3 are depicted as being reflected to the primary portion of the core of transformer 10.

It should be noted that unless the control winding 72 is closely coupled to the secondary winding 14, there will be sufficient energy stored in the leakage reactance 88 to cause significant error in the output voltage regulation. Furthermore, leakage reactance 84 should be as large as possible in order to limit the peak currents that triac 74 is required to conduct. In practice, the control winding 72 can be a tap or portion of the capacitor winding 16, providing that close coupling is maintained with the secondary winding 14. The capacitor winding 16 is preferably wound concentric with the secondary winding 14 in order to keep the leakage reactance 88 at a minimum while still obtaining the desired isolation between these two windings due to the relatively high voltage present on the secondary winding 14.

The present invention provides a relatively uncomplicated power supply with precise voltage regulation. It will be understood that the illustrated embodiment is intended as an exemplification of the invention and that it is not limited thereto. The appended claims are thus intended to cover and embrace any modifications and adaptations of the invention as fall within the true spirit and scope of the invention.

What is claimed is:

1. In a regulated power supply circuit of the type for providing a predetermined magnitude of DC voltage across an output capacitor from a primary AC power source including a power transformer having a primary winding interruptably connected to the AC source by a gated triac, a first secondary winding for producing an AC output voltage, rectifying means interconnecting the first secondary winding and the output capacitor for converting the AC output voltage to a DC voltage on the capacitor and regulating means connected for sensing the voltage on the capacitor and for interrupting the connection between the AC source and the transformer primary winding by terminating a gate signal to the triac when the capacitor voltage reaches a predetermined magnitude, the improvement comprising:

(a) a control winding wound on the power transformer, said control winding having a pair of output terminals;

(b) controllable switch means connected between said pair of control winding output terminals for selectively short-circuiting said control winding; and, (c) means responsive to the termination of the gate signal to the triac for energizing said switch means whereby said control winding is short circuited and further enhancement of the voltage on the output capacitor is inhibited.

2. The improvement of claim 1 wherein said controllable switch means comprises a triac.

3. The improvement of claim 1 wherein the power transformer includes an additional secondary winding having a pair of output terminals between which a capacitor is connected for power factor improvement.

4. The improvement of claim 3 wherein said control winding is closely coupled to the first secondary winding and loosely coupled to said additional secondary winding.

5. The improvement of claim 4 wherein the output capacitor is connected in an energizing circuit for a flash lamp, said energizing circuit comprising:

(a) a pulse transformer having a primary winding and a secondary winding, said secondary winding being connected in a series circuit including said lamp and said output capacitor; and (b) a pulse source connected for applying a voltage pulse to said primary winding of said pulse transformer whereby a voltage of sufficient magnitude to energize said flash lamp is developed across said pulse transformer secondary winding, said output capacitor thereafter providing a predetermined magnitude of energy to control the light intensity of said lamp.

* * * * *